United States Patent [19]

Lount

[11] 4,229,920

[45] Oct. 28, 1980

[54] FOAMED PLASTIC CONCRETE FORM AND CONNECTORS THEREFOR

[75] Inventor: William D. Lount, Winnipeg, Canada

[73] Assignee: Frank R. Lount & Son (1971) Ltd., Winnipeg, Canada

[21] Appl. No.: 945,524

[22] Filed: Sep. 25, 1978

[30] Foreign Application Priority Data

Oct. 5, 1977 [GB] United Kingdom ..... 41420/77

[51] Int. Cl.[3] ..... E04B 2/32; E04C 2/20

[52] U.S. Cl. ..... 52/309.12; 52/426

[58] Field of Search ..... 52/562, 563, 564, 565, 52/309.4, 309.11, 309.12, 569, 570, 571, 561, 426

[56] References Cited

U.S. PATENT DOCUMENTS

| | | | |
|---|---|---|---|
| 1,911,626 | 5/1933 | Larzelere | 52/562 |
| 2,086,571 | 7/1937 | Novambere | 52/561 |
| 2,630,701 | 3/1953 | Zeller | 52/565 |
| 2,942,454 | 6/1960 | Jackson | 52/564 |
| 3,788,020 | 1/1974 | Gregori | 52/309.12 |
| 3,992,839 | 11/1976 | La Borde | 52/570 |

FOREIGN PATENT DOCUMENTS

| | | | |
|---|---|---|---|
| 1271208 | 7/1961 | France | 52/426 |

*Primary Examiner*—John E. Murtagh
*Attorney, Agent, or Firm*—Stanley G. Ade

[57] ABSTRACT

Panels are formed from foamed plastic or the like, with anchor members embedded in the inner faces and having connector engaging portions extending from one face of the panel. A pair of panels is held in spaced and parallel relationship by a plastic connector member which is slidably engaged within the anchor portions extending from the panels. The anchor portions are situated adjacent each end of the panels and have upper and lower extending portions spaced from the upper and lower edges of the panels. The connectors each have upper and lower anchoring engaging portions so that a four point connection is made between each pair of panels. Concrete may then be poured between the panels which act as forms and remain in place.

6 Claims, 8 Drawing Figures

FOAMED PLASTIC CONCRETE FORM AND CONNECTORS THEREFOR

BACKGROUND OF THE INVENTION

This invention relates to new and useful improvements in foamed plastic concrete forms and connectors extending therebetween so that said forms can be erected, and consist of two substantially rectangular rigid foamed plastic panels held in spaced apart relationship by means of plastic connectors so as to form forms for concrete which is poured therebetween, it being understood that the foamed plastic panels remain after the concrete has been set to form an integral panel structure.

Conventionally, concrete forms consist of plywood or wooden or metal panels temporarily maintained in spaced apart and parallel relationship by means of ties. The concrete is poured between these forms which are then stripped away after the concrete has set up. These are extremely expensive and awkward to manufacture, store and ship.

Alternatively, foamed plastic panels have been utilized with the panels being interconnected by tension members which are embedded in projections integrally formed on inner faces of the panels and this construction is exemplified by Canadian Pat. No. 838,601.

However, this particular form suffers from several disadvantages. Firstly because of the construction thereof, left and righthanded panels have to be manufactured and the interconnecting strips have to be secured one to the other either by nuts and bolts or by embedding same into projecting portions on the inner faces of the foam panels, during manufacture. Due to the inherent construction of such forms, it is necessary to have right and lefthanded panels as aforesaid.

SUMMARY OF THE INVENTION

The present invention overcomes these disadvantages by providing a rigid foamed polymeric panel substantially rectangular in configuration and having connector anchor portions embedded therein into which can be engaged connectors to maintain a pair of panels in parallel spaced relationship when the structure is assembled.

The individual panels are tongue and grooved on opposing edges so that they interlock one with the other and one of the most important aspects of the invention is the fact that one panel can be used in either the left or righthand location so that matched pairs are not required.

Another advantage of the present invention is the fact that the connectors can be of different dimensions so that the spacing between pairs of panels can be varied to suit design parameters.

Another aspect of the invention is the fact that because of the dimensioning of the connectors and the like, it is relatively easy to ensure that the space between adjacent panels is completely filled with concrete.

With the foregoing in view, and other advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
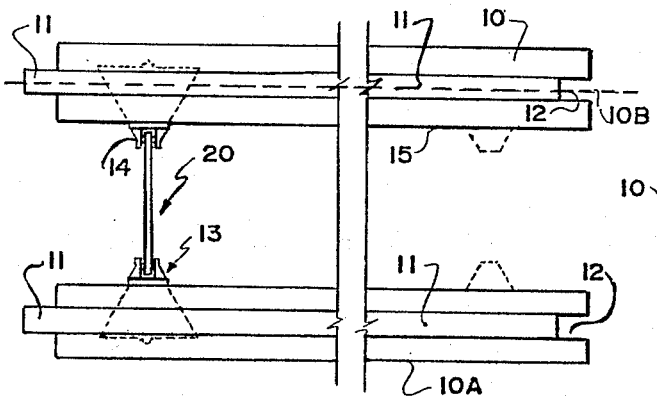
FIG. 1 is a top plan view of a pair of panels with connectors extending therebetween.
Figure 2:
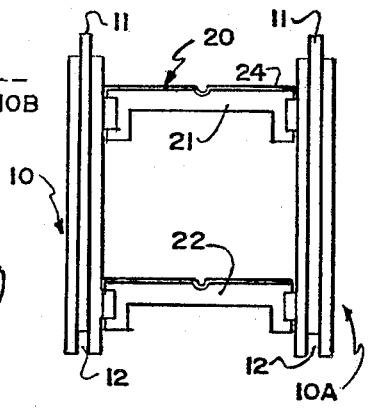
FIG. 2 is an end view of FIG. 1.

Proceeding therefore to describe the invention in detail, reference character 10 illustrates a substantially rectangular panel of rigid foamed polymeric material such as expanded polystyrene.

Although the dimensions can be changed to suit design parameters, nevertheless a convenient size for manufacturing said panels is approximately 4 feet in length and 16 inches in height.

Each of these panels is provided with a projecting tongue 11 on one end and on one side and a corresponding groove 12 on the opposite end and upon the opposite side edges so that adjacent panels will interlock in end to end relationship and also will interlock when placed one above the other.

During the formation of the individual panels, connector anchors collectively designated 13, are embedded so that portions 14 extend beyond the inner face 15 of the panels with the remainder of the anchor being embedded within the panel.

Figure 3:
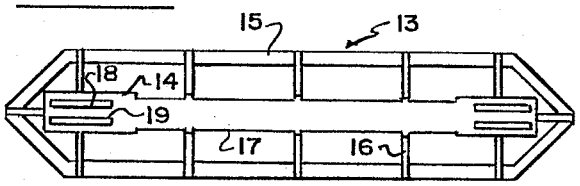
FIG. 3 is an enlarged top plan view of one of the connector anchors.
Figure 5:
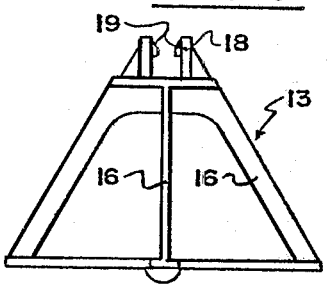
FIG. 5 is an end elevation of FIG. 3.
Figure 4:
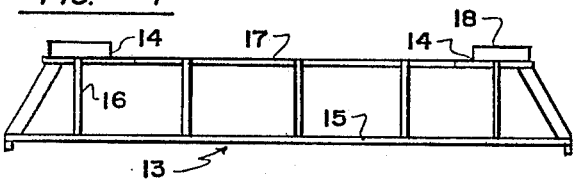
FIG. 4 is a side elevation of FIG. 3.

These anchors are shown in detail in FIGS. 3, 4 and 5 and preferably are made of synthetic plastic. They include an open substantially rectangular base 15, upwardly and inwardly inclining webs 16 and a centrally located upper main support 17 upon which portions 14 are formed. Each of these portions 14 include a pair of spaced and parallel flanges 18 having inturned or internally beaded upper or outer edges 19 as clearly shown in FIG. 5 and these are situated adjacent each end of the central rib or portion 17 as clearly illustrated.

When embedded vertically within the panels 10, these portions 18 and 19 extend inwardly from the inner surface 15 of the panel as clearly shown and as they are centrally located between the upper and lower edges of the panel, it will be appreciated that the panel 10 can be reversed in position to form the opposing panel 10A so that only one mould and one type of panel need be manufactured. By vertically, it means, situated at right angles to the longitudinal axis 10B of the panel 10.

A common connector collectively designated 20 is also formed preferably of synthetic plastic and is adapted to be slidably engaged between adjacent pairs of vertically spaced member or portions 14 thus holding the two panels 10 and 10A in parallel spaced relationship one with the other as clearly shown in FIG. 1.

The connectors 20 consist of upper and lower transverse portions 21 and 22 which are held in position by the anchor portions 23.

Figure 7:
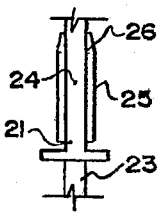
FIG. 7 is an enlarged fragmentary end view of one end of the connector of FIG. 6.
Figure 6:
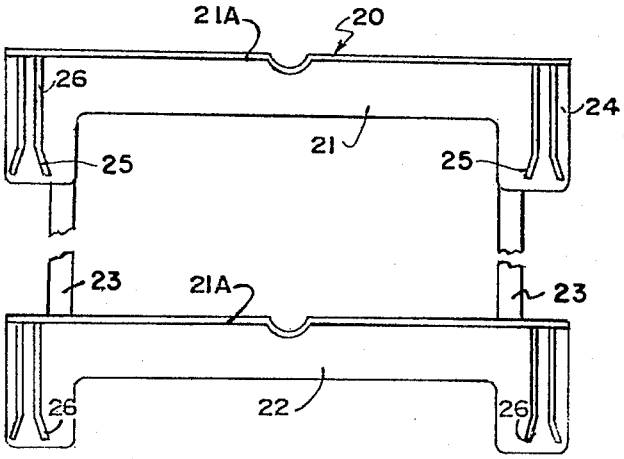
FIG. 6 is a front elevation of the connector per se.
Figure 8:
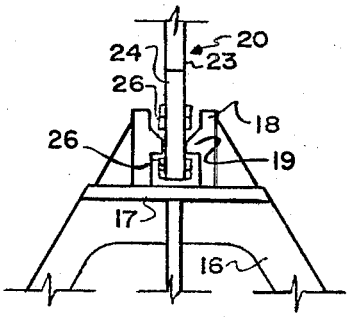
FIG. 8 is an enlarged fragmentary view showing the engagement of the connector with the connector anchor.

Adjacent the outer ends 24 of each of the portions 21 and 22, pairs of spaced and parallel ribs 25 are formed on both sides of the portions 24 and adjacent each end thereof as clearly shown in FIGS. 6, 7 and 8. These spaced and parallel ribs 25 are provided with outturned lead-in ends 26 to facilitate the engagement therebetween of the inturned portions 19 when the connectors are engaged between the portions 14 in assembling the panels. In other words, these outturned ends 26 of the ribs act as lead-in portions for the inturned portions 19.

In assembly, a pair of panels 10 and 10A are held in the desired relationship whereupon connectors 20 are slid downwardly between adjacent pairs of vertically spaced anchors 14 thus forming a rigid two paneled form into which concrete is poured. In this position, the ribs 25 on each side of the upper portion 21 engage between the upper connectors 14 of the opposed panels and ribs 25 on each side of the lower portions 22 engage between the lower connectors 14 of the opposed panels.

When the connectors 20 are engaged with the anchors 14, they are maintained in position by friction in the relationship shown in detail in FIG. 8 and are prevented from moving further relative to the anchors because the anchors engage against the transverse flanges 21A on the edges of the portions 21.

Once the concrete has been poured, the connectors and panels are bonded together with the concrete and the appropriate finish can be applied to the outer surfaces of the panels to form the finished wall.

It will of course be appreciated that the panels 10 and 10A are constructed to form the entire wall form for the concrete.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention:

1. A form for concrete walls and the like comprising in combination a pair of substantially rectangular foamed plastic panels, and means to maintain said panels in spaced and parallel relationship, said means including cooperating pairs of vertically situated anchor means embedded within said panels, connector engaging means extending from each of said pair of anchor means and protruding from one face of said panels, and a connector slidably engaging upon said corresponding pairs of connector engaging means in detachable locking relationship thereby holding said panels in the said spaced and parallel relationship, each said pair of anchor means including a base portion embedded within said panel with said connector engaging means extending therefrom, each said anchor means including an upper and lower connector engaging means situated substantially at right angles to the longitudinal axis of said panel in spaced apart relationship one above the other and spaced from the upper and lower edges of said panel by a similar amount and also being spaced inwardly from the ends of said panel by a similar amount whereby said panels are interchangeable and reversible end to end, said connector including a vertically situated frame and upper and lower portions on each side of said frame operatively engaging with the corresponding connector engaging means of said anchor means, a pair of jaws on each of said connector engaging means and guide means formed on said portions of said connector slidably engageable within said jaws.

2. The form according to claim 1 which includes means to limit the amount of sliding engagement of said connector with said connector engaging means.

3. The form according to claim 1 which includes a pair of anchor means one adjacent each end of said panels and a pair of connectors, one for each of said anchor means.

4. The form according to claim 1 which includes a pair of anchor means one adjacent each end of said panels and a pair of connectors one for each of said anchor means.

5. The form according to claims 1, 2, or 3 in which said panels include means formed along the edges thereof engageable with corresponding means on adjacent panels whereby said panels upon one side of said form all interengage together and panels on the other side of said form also all interengage together.

6. The form according to claim 4 in which said panels include means formed along the edges thereof engageable with corresponding means on adjacent panels whereby said panels upon one side of said form all interengage together and panels on the other side of said form also all interengage together.

* * * * *